US005669856A

United States Patent [19]

Liu

[11] Patent Number: 5,669,856

[45] Date of Patent: Sep. 23, 1997

[54] EXERCISER

[76] Inventor: Chien-Hsing Liu, No. 460, Kuang-Fu Road, Pei-Tou Chen, Chang-Hua Hsien, Taiwan

[21] Appl. No.: 680,954

[22] Filed: Jul. 16, 1996

[51] Int. Cl.[6] ..... A63B 22/04

[52] U.S. Cl. ..... 482/51; 482/51; 482/52; 482/53; 482/54

[58] Field of Search ..... 482/51–54, 112, 482/71, 72, 111, 74

[56] References Cited

U.S. PATENT DOCUMENTS

| | | | |
|---|---|---|---|
| 4,708,338 | 11/1987 | Potts | 482/52 |
| 5,336,146 | 8/1994 | Piaget et al. | 482/54 |
| 5,538,489 | 7/1996 | Magid | 482/54 |

*Primary Examiner*—Jerome Donnelly
*Attorney, Agent, or Firm*—Morton J. Rosenberg; David I. Klein

[57] ABSTRACT

An exerciser including a base having an extension portion upward extending from a top side of the base. A handle portion is disposed at top end of the extension portion. Two pedals are side by side disposed on rear side of the base and spaced by a predetermined distance. Each pedal is connected to the extension portion via a hydraulic cylinder. Each pedal is disposed with a first rotary shaft and a second rotary shaft. A rolling belt is drivingly wound around the first and second rollers. The first rotary shaft is disposed with a sprocket and a fly wheel. A chain is wound around the sprocket. Two ends of the chain are respectively secured to the base and the extension portion. When a user steps down the pedal, the sprocket is moved along the chain and the first and second rotary shafts as well as the rolling belt are driven to move toward the rear side of the user's foot, whereby the user is subject to a forward rushing force which makes the user have a feeling like running mountaineering or stairs climbing.

5 Claims, 5 Drawing Sheets

EXERCISER

BACKGROUND OF THE INVENTION

The present invention relates to an exerciser including a rolling belt which can be moved in only one direction, whereby when a user steps down a pedal, the rolling belt is simultaneously driven to move toward the rear side of the user's foot to create a feeling like running mountaineering or stairs climbing.

A conventional electric running machine employs a rolling belt having fixedly set rotational speed which cannot be automatically adjusted in accordance with the running speed of a user. Therefore, the user must run at a speed pursuant to the set speed of the rolling belt. In case that the user stops running or slows down the running movement due to tiredness and pain, the rolling belt of the running machine will keep rotating at a constant speed. This often makes the user fall down. Also, although the inclination angle of the running machine is adjustable, such inclination angle is too small to create a feeling of running up on a slope.

Another conventional stepping machine provides the user with a stepping exercise. Such stepping exercise is quite smooth and the user's feet always fail to parallelly move on the pedals. Therefore, no exercising effect of mountaineering or stairs climbing is achieved.

SUMMARY OF THE INVENTION

It is therefore a primary object of the present invention to provide an exerciser including a rolling belt which can be moved in only one direction, whereby when a user steps down a pedal, the rolling belt is simultaneously driven to move toward the rear side of the user's foot to create a feeling like running mountaineering or stairs climbing.

According to the above object, the exerciser of the present invention includes a base having an extension portion upward extending from a top side of the base. A handle portion is disposed at top end of the extension portion. Two pedals are side by side disposed on rear side of the base and spaced by a predetermined distance. Each pedal is connected to the extension portion via a hydraulic cylinder. Each pedal is disposed with a first rotary shaft and a second rotary shaft. A rolling belt is drivingly wound around the first and second rollers. The first rotary shaft is disposed with a sprocket and a fly wheel. A chain is wound around the sprocket. Two ends of the chain are respectively secured to the base and the extension portion.

The present invention can be best understood through the following description and accompanying drawing, wherein:

DETAILED DESCRIPTION OF THE PREFERRED EMBODIMENTS

Figure 1:
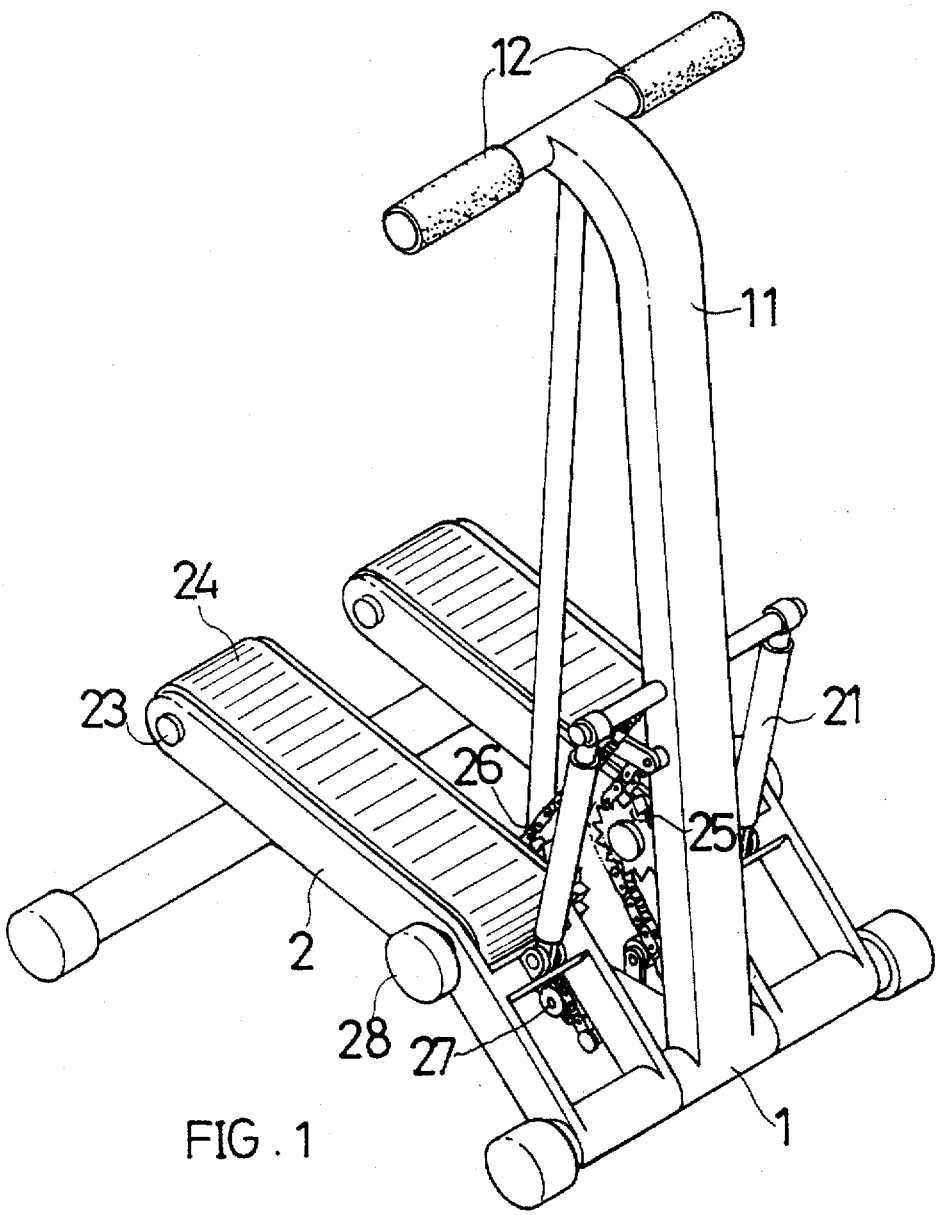
FIG. 1 is a perspective assembled view of the first preferred embodiment of the present invention.
Figure 2:
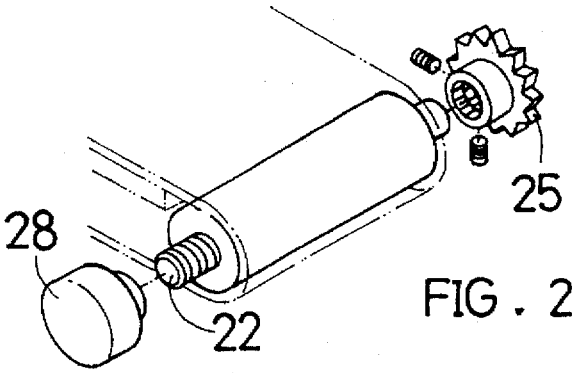
FIG. 2 is a perspective exploded view of the rotary shaft of the present invention.
Figure 3:
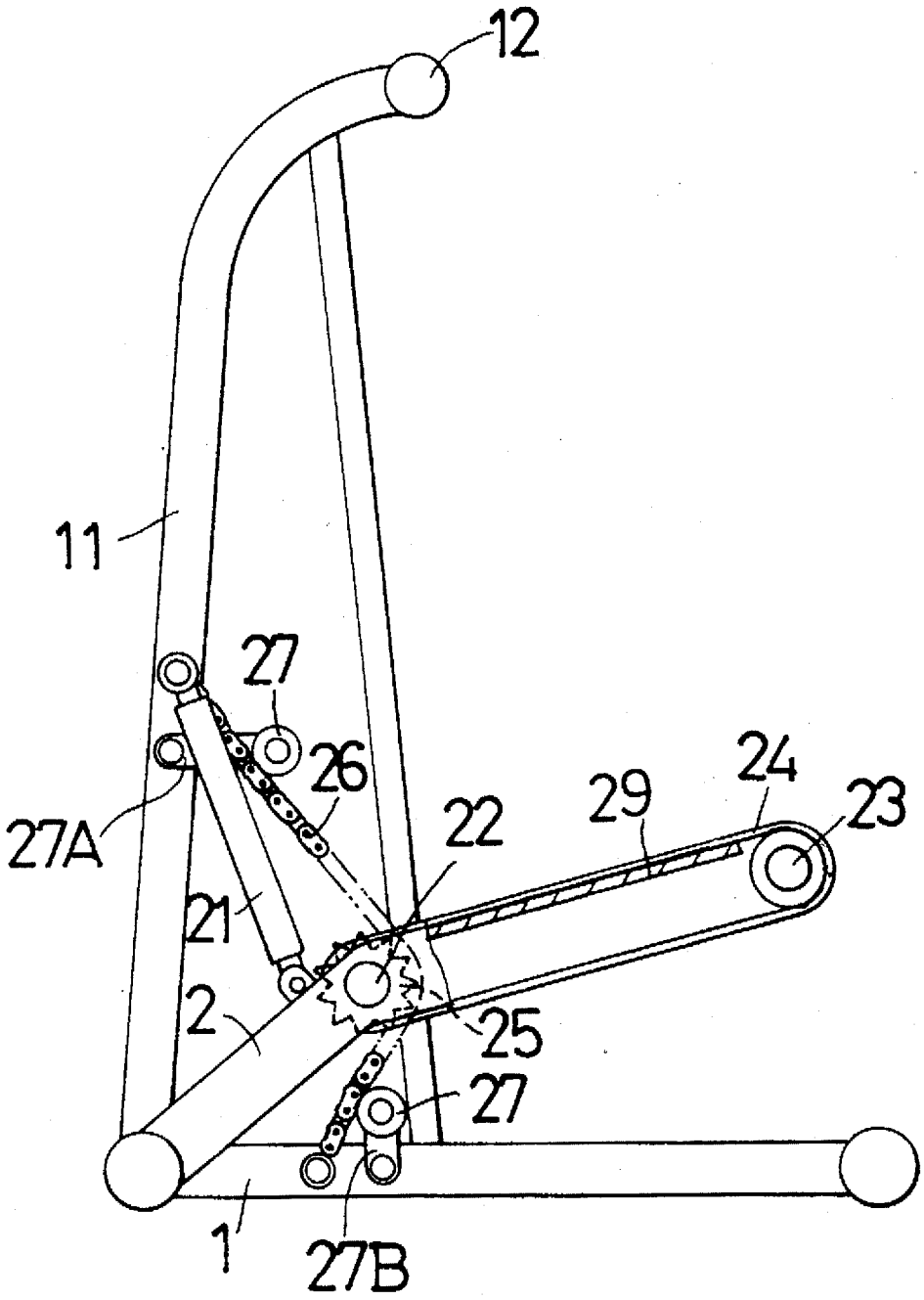
FIG. 3 is a side view of the present invention.

Please refer to FIGS. 1 to 3. The first preferred embodiment exerciser of the present invention includes a base 1 having an extension portion 11 upward extending from a top frontal side of the base 1. A handle portion 12 is disposed at top end of the extension portion 11. Two pedals 2 are side by side disposed on rear side of the base 1 and spaced by a predetermined distance. Each pedal 2 is connected to the extension portion 11 via a hydraulic cylinder 21, whereby by means of the reciprocation of the hydraulic cylinder 21, the pedals 2 can alternately move up and down. In this embodiment, the hydraulic cylinder 21 is a hydraulic cylinder having an internal spring for quick restoration.

Each pedal 2 is disposed with a first rotary shaft 22 near the extension portion 11 of the base 1 and a second rotary shaft 23 distal from the extension portion 11. A rolling belt 24 is drivingly wound around the first and second rollers 22, 23. The rotary shafts 22, 23 can rotate in only one direction. The outer face of the rolling belt 24 is a slip-proof face, while the inner face of the rolling belt 24 contacts with an inner board 29. The inner board 29 serves as a sliding interface for the rolling belt 24 and serves to bear a user's weight. A sprocket 25 is disposed at one end of the first rotary shaft 22 and an inertial fly wheel 28 is disposed at the other end of the first rotary shaft 22.

A chain 26 is wound around each sprocket 25. Two ends of the chain 26 are respectively secured to the base 1 and the extension portion 11. Two resiliently retained idlers 27 press each chain 26 against the sprocket 25 to keep the chain 26 meshing with the sprocket 25 by at least five teeth. These two idlers 27 are respectively supported by a upper idler rod 27A (connected with the extension portion 11) and a lower idler rod 27B (connected with the base 1). The rotary shaft 22 can rotate only in one direction so that although the sprocket 25 can be moved up and down on the chain 26, the first rotary shaft 22 can be driven to rotate in only one direction. Therefore, the rolling belt 24 can be only moved rearward. The inertial fly wheel 28 serves to enhance the rotational inertia of the rotary shaft 22, enabling the rolling belt 24 to more smoothly rotate.

Figure 4:
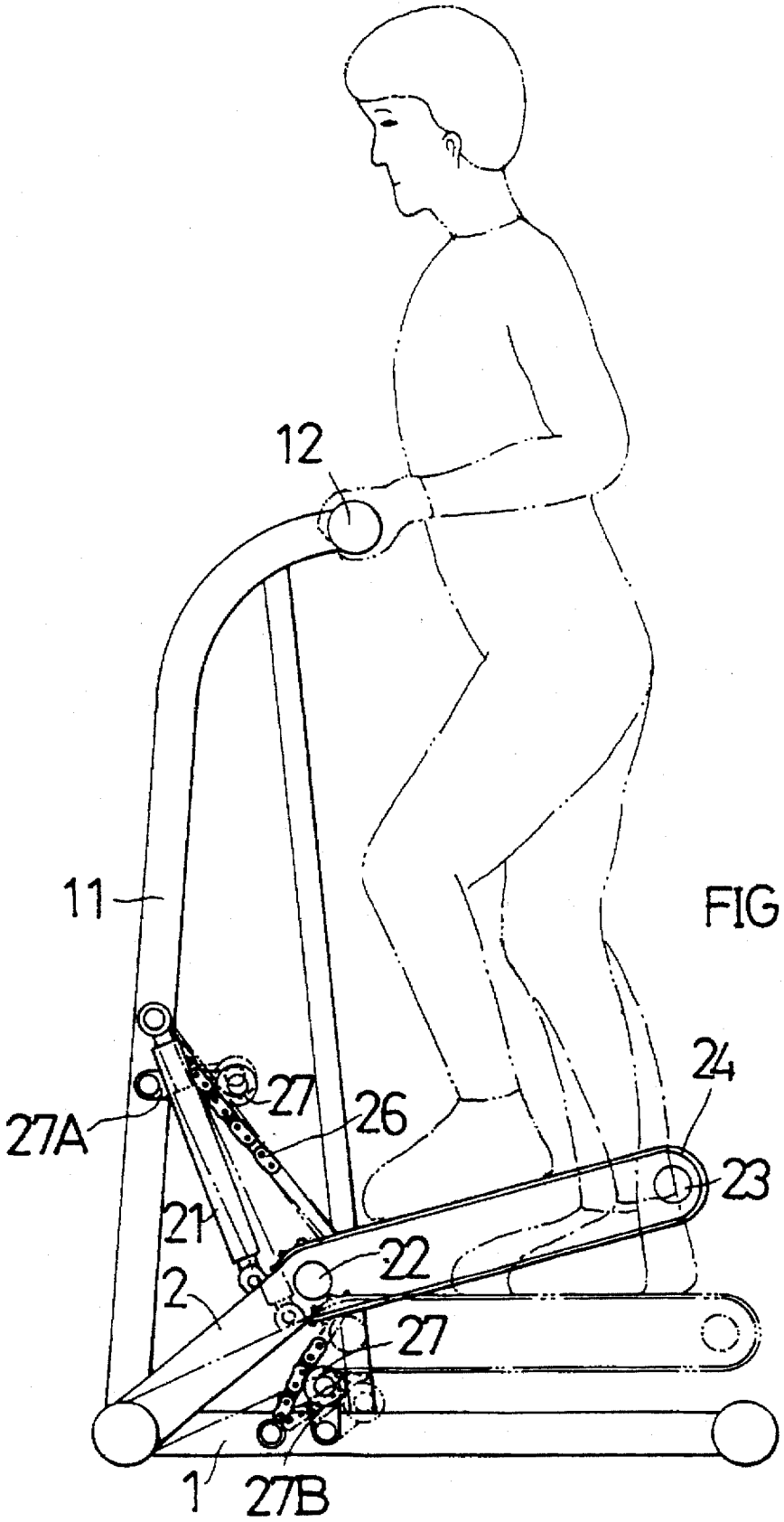
FIG. 4 is a side view showing the operation of the present invention.

Referring to FIGS. 3 and 4, according to the above arrangements, when the user steps down the pedal 2, the hydraulic cylinder 21 is elongated to drive the sprocket 25 to roll along the chain 26. At this time, the first and second rotary shafts 22, 23 and the rolling belt 2 are driven to move toward the rear side of the user's foot in a direction as shown by the arrow, whereby the user's foot will slide rearward through a small distance. By means of the rearward sliding movement of the user's foot, the user is subject to a forward rushing force which makes the user feel like running on a running machine. By means of the alternate up and down stepping movement of the user's left and right feet, a whole new running mountaineering or stairs climbing feeling is created.

Figure 5:
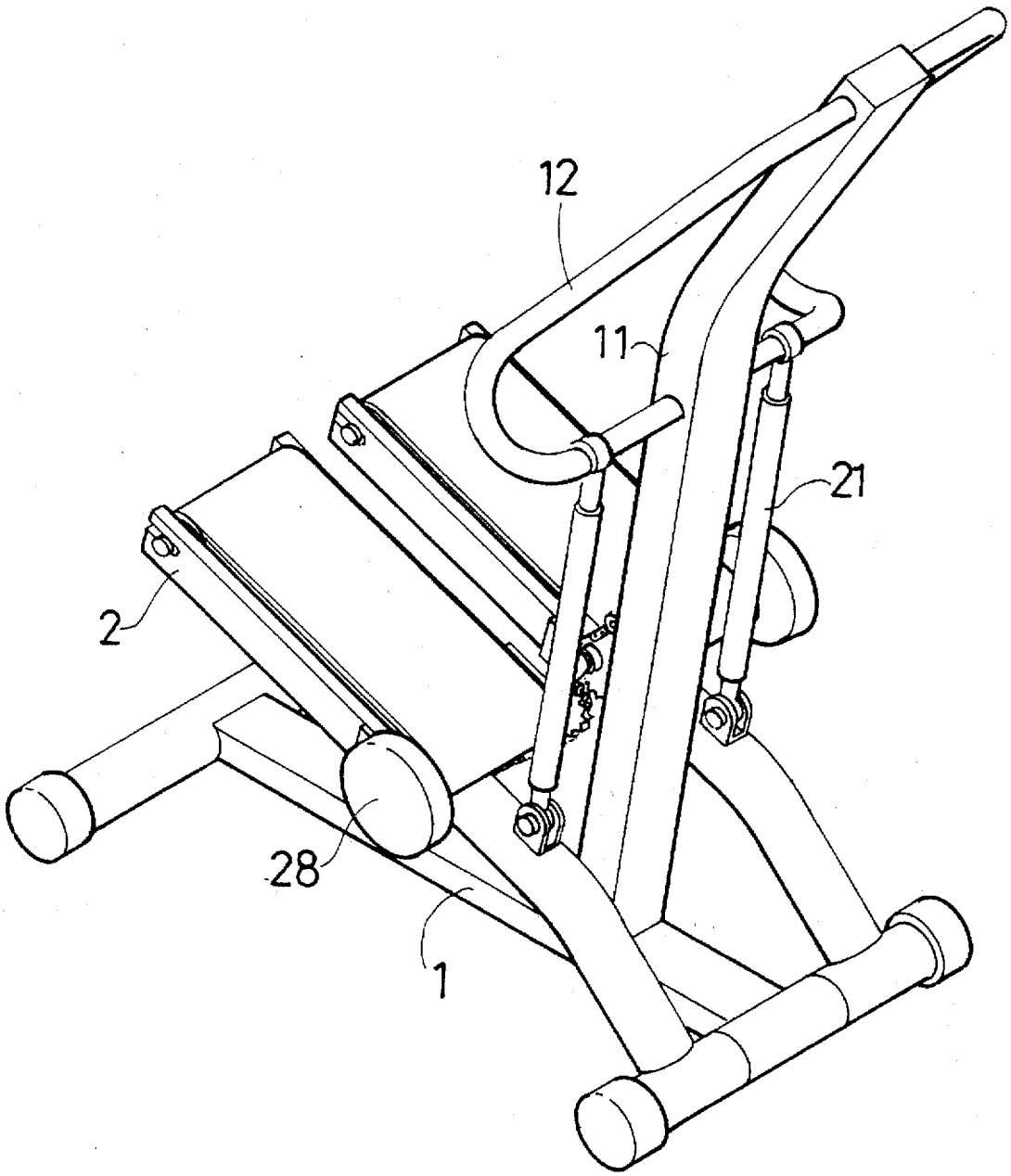
FIG. 5 is a perspective view of the second preferred embodiment of the present invention.
Figure 6:
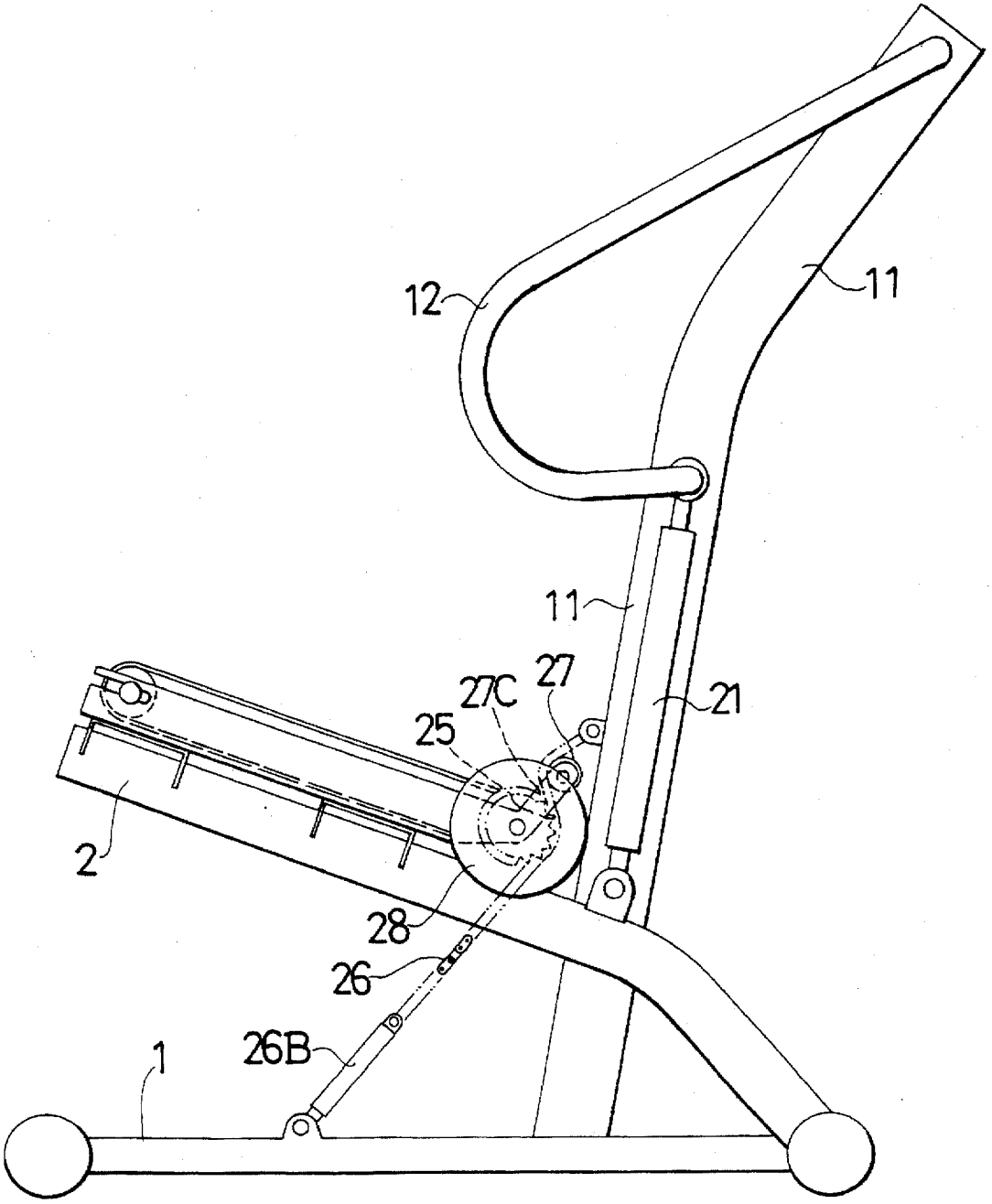
FIG. 6 is a side view of the second preferred embodiment of the present invention.

Please refer to FIG. 5 and FIG. 6. It is the second preferred embodiment of the present invention. The handle portion 12 is made of a bent pipe or rod. Also, each chain 26 only needs one idler 27 and the idler 27 is disposed on the pedals 2 by a fixed idler arm 27C. Thus, only two idlers 27 are needed in the second embodiment.

Furthermore, referring to FIG. 6, the idler 27 is supported by an idler arm 27C. In which, the idler arm 27C is fixed on the inner side of the pedal 2. In addition, a spring 26B (or any resilient device) is connected between one end of the train 26 and the base 1. Therefore, the train 26 can pass through the sprocket 25 and the idler 27 with proper tightness.

It should be noted that the exerciser of the present invention employs the sprocket which moves back and forth along the fixed chain. When the sprocket is moved downward, the rolling belt is driven to rotate, while when the sprocket is moved upward, the rolling belt is prevented from rotating.

In addition, the more quickly the pedal is stepped down, the faster the sprocket is rotated and the faster the rolling belt is rotated. This is also true in a reverse state. Accordingly, the rotational speed of the rolling belt can be automatically adjusted in accordance with the speed of the movement of the user. Therefore, almost no physical injury will take place due to improper cooperation in speed during exercising. Also, the user can adjust the tightness of contact between the idler and the chain so as to adjust the force exerted onto the pedal.

It is to be understood that the above description and drawings are only used for illustrating one embodiment of the present invention, not intended to limit the scope thereof. Any variation and derivation from the above description and drawings should be included in the scope of the present invention.

What is claimed is:

1. An exerciser comprising a base having an extension portion upward extending from a top side of the base, a handle portion being disposed at top end of the extension portion, two pedals being side by side disposed on rear side of the base and spaced by a predetermined distance each of said pedals being pivotally coupled to a frontal portion of said base, each pedal being connected to the extension portion via a hydraulic cylinder, said exerciser being characterized in that:

each pedal is disposed with a first rotary shaft and a second rotary shaft, a rolling belt being drivingly wound around the first and second rollers, the first rotary shaft being disposed with a sprocket, a chain being wound around the sprocket, two ends of the chain being respectively secured to the base and the extension portion.

2. An exerciser as claimed in claim 1, wherein at least one resiliently retained idler presses the chain against the sprocket to keep the chain meshing with the sprocket by at least five teeth.

3. An exerciser as claimed in claim 1, wherein an outer face of each rolling belt is a slip-proof face.

4. An exerciser as claimed in claim 1, wherein each rotary shaft can be rotated in only one direction.

5. An exerciser as claimed in claim 1, wherein said exerciser further comprises two springs, each spring being connected between one end of a chain and the base.

* * * * *